US012157067B2

(12) United States Patent
Black

(10) Patent No.: US 12,157,067 B2
(45) Date of Patent: Dec. 3, 2024

(54) DURABLE PROGRAMMABLE ILLUMINATED REPLICA EYE AND A METHOD OF MAKING THE SAME

(71) Applicant: Nicholas Black, Stamford, CT (US)

(72) Inventor: Nicholas Black, Stamford, CT (US)

( * ) Notice: Subject to any disclaimer, the term of this patent is extended or adjusted under 35 U.S.C. 154(b) by 180 days.

(21) Appl. No.: 18/154,954

(22) Filed: Jan. 16, 2023

(65) Prior Publication Data

US 2024/0238682 A1 Jul. 18, 2024

(51) Int. Cl.

| | |
|---|---|
| ***A63H 3/38*** | (2006.01) |
| ***A63H 3/00*** | (2006.01) |
| ***A63H 3/42*** | (2006.01) |

(52) U.S. Cl.

CPC ..... *A63H 3/006* (2013.01); *A63H 3/38* (2013.01)

(58) Field of Classification Search

CPC ..... A63H 3/38; A63H 3/42

See application file for complete search history.

(56) References Cited

U.S. PATENT DOCUMENTS

| | | | | |
|---|---|---|---|---|
| 3,120,720 A | | 2/1964 | Brudney | |
| 4,602,084 A | | 7/1986 | Hurter | |
| 4,752,273 A | | 6/1988 | Woods | |
| 4,875,888 A | * | 10/1989 | Harvey | A63H 3/38 446/389 |
| 5,004,443 A | * | 4/1991 | Su | A63H 3/38 446/485 |
| 7,988,523 B2 | | 8/2011 | Chang et al. | |
| 2009/0318057 A1 | | 12/2009 | Sip et al. | |
| 2010/0136880 A1 | | 6/2010 | Liu | |
| 2013/0217300 A1 | | 8/2013 | Skifstrom et al. | |

* cited by examiner

*Primary Examiner* — John A Ricci

(74) *Attorney, Agent, or Firm* — Dunlap Bennett & Ludwig, PLLC

(57) ABSTRACT

A replica eye with programmable iris illumination and a method of making the same is provided. The replica eye includes a programmable lighting element having a planar base with electrical pins outward of a centrally disposed light source is electrically coupled via the pins to one or more electrical connections. One end of a transparent cylinder approximately coextensively abuts the light source. The outer portions of the planar base and its electrical connections are folded into a folded assembly that is received into and adhered along an inner circumferential wall of a ring. The electrical connections are further adhered along a rear portion of the ring and planar base. A semi-spherical dome sandwiches an opaque body to an opposing end of the transparent cylinder, thereby defining an illuminable iris and pupil, respectively.

15 Claims, 6 Drawing Sheets

DURABLE PROGRAMMABLE ILLUMINATED REPLICA EYE AND A METHOD OF MAKING THE SAME

BACKGROUND OF THE INVENTION

The present invention relates to illuminable replica eyes and, more particularly, a durable representation of an eye with an iris having evenly distributed, programmable light.

Currently replica eyes, for toys, dolls, fashion accessories, visual art presentations, and the like do not evenly distribute light throughout the iris, are not physically durable (and thus eventually stop illuminating because of an electrical disconnection or short), and are not easily attached to something (i.e., a face) via an eye hole.

As can be seen, there is a need for a durable representation of an eye with an iris having evenly distributed, programmable light, wherein the eye replica can be used for toys, dolls, clothing, fashion accessories, visual art presentations, and the like.

SUMMARY OF THE INVENTION

In one aspect of the present invention, a replica eye with programmable iris illumination, the replica eye includes the following: a programmable lighting element having a planar base with a plurality of electrical pins outward of a centrally disposed light source; one or more electrical connections electrically coupled to the plurality of electrical pins; a transparent cylinder extending between a first and a second end, wherein the first end approximately coextensively overlays the light source; and wherein outward portions of the planar base and their electrical connections are folded upward to extend generally parallel with the sidewalls of the cylinder to an elevation above that of the light source.

In another aspect of the present invention, the replica eye further includes an opaque body disposed along the second end of the cylinder; an iris cap receiving said second and the opaque body, wherein the opaque body is a disc, wherein the iris cap is a semispherical object with a hole for receiving said second end; further including a ring for receiving the folded outward portion so that they can be adhered to an inner circumference of the ring; and further including a conical shape recessed in the second end.

In yet another aspect of the present invention, a method of making a replica eye with programmable iris illumination includes the following: electrically coupling one or more electrically connections to a programmable lighting element having a planar base with a plurality of electrical pins outward of a centrally disposed light source; coextensively abutting one end of a transparent cylinder to an upper surface of the light source; folding outward portions of the planar base and their electrical connections upward to extend generally parallel with the sidewalls of the cylinder to an elevation above that of the light source; adhering the folded outward portions along an inner circumference of a ring; further adhering the one or more electrical connections along a rear portion of the ring; and adhering an opaque body to another end of the cylinder; and sliding an iris cap over said other end and opaque body.

These and other features, aspects and advantages of the present invention will become better understood with reference to the following drawings, description and claims.

DETAILED DESCRIPTION OF THE INVENTION

Figure 1:
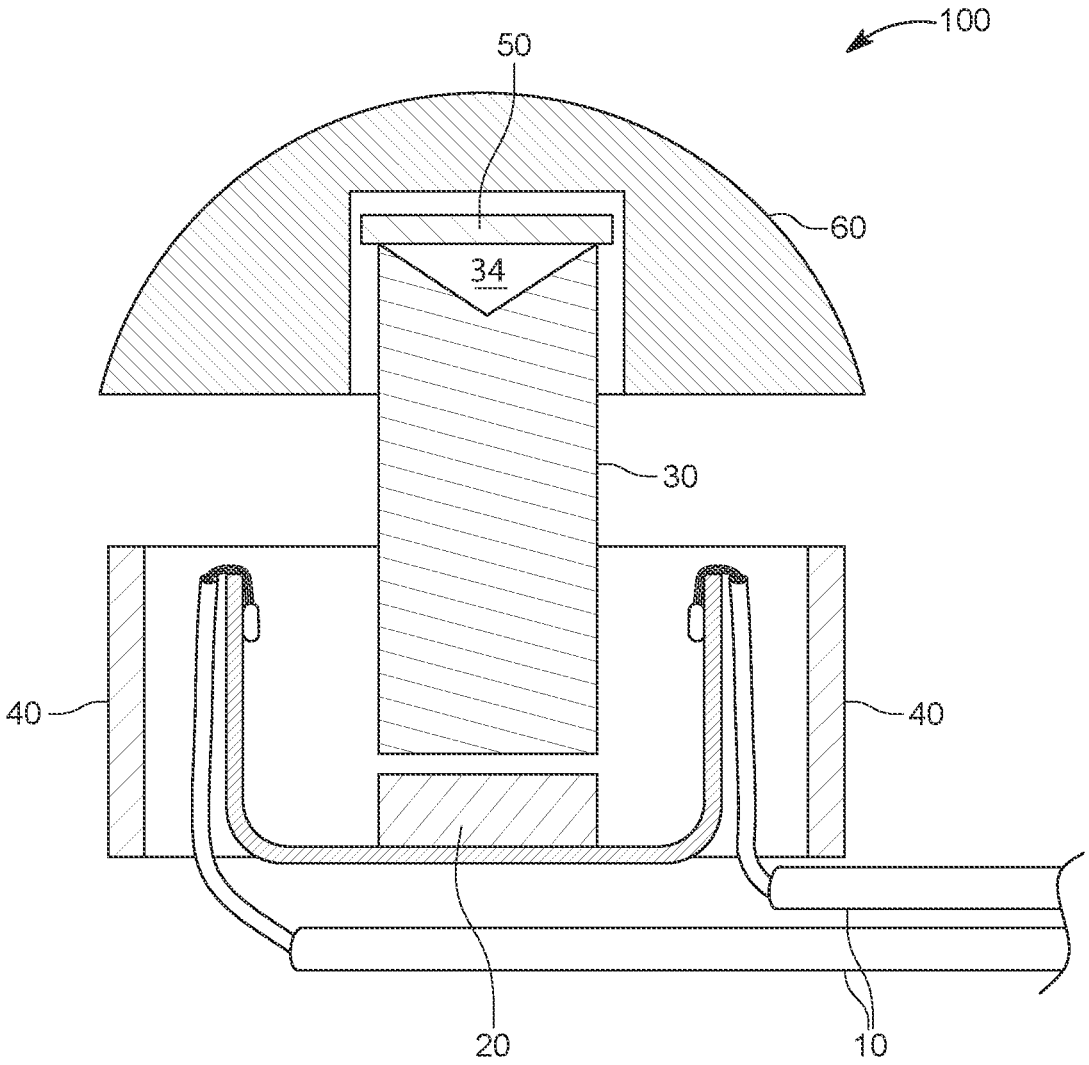
FIG. 1 is a cross-sectional view of an exemplary embodiment of the present invention, adhesive and target installation material are not shown for clarity.
Figure 2:
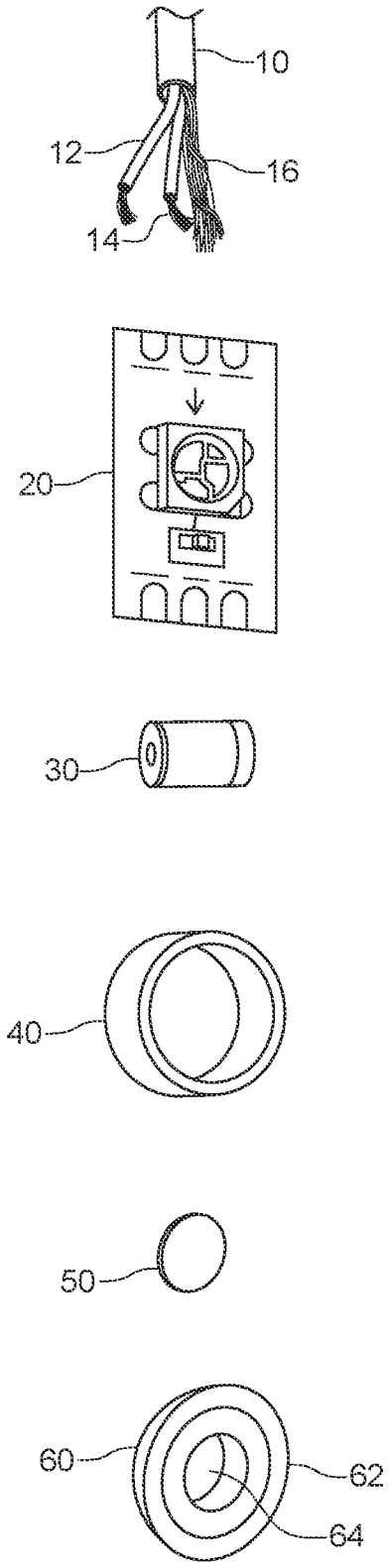
FIG. 2 is an exploded perspective view of an exemplary embodiment of the present invention.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, the present invention may include a replica eye with programmable iris illumination and a method of making the same. The replica eye may include a programmable lighting element having a planar base with electrical pins outward of a centrally disposed light source that is electrically coupled via the pins to one or more electrical connections. A transparent cylinder, having a diameter approximately coextensive with an upper surface of the light source, abuts the light source. The outer portions of the planar base and its electrical connections are folded into a folded assembly that is received into and adhered along an inner circumferential wall of a ring. The electrical connections are further adhered along a rear portion of the ring and planar base. A semi-spherical dome sandwiches an opaque body to an opposing end of the transparent cylinder, thereby defining an illuminable iris and pupil, respectively.

Referring now to FIGS. 1 through 7, the present invention may include a programmable illuminated replica eye 100 having the following systemic components: one or more electrical connections 10 with at least three, separate signal connectors 12, 14, and 16; a programmable lighting element 20; a translucent, transparent, or semi-transparent cylinder 30 (the cylinder 30 may be made from clear plastic or other durable material allowing the transmission of light therethrough, wherein the cylinder 30 optionally has a cone 34 drilled out on one end 32); a ring 40 (made out of plastic or equivalent durable material); an opaque disc 50 (which may be made from any material that blocks light); a translucent, transparent, or semi-transparent semi-sphere 60 with hole 64 drilled into a flat end 62, forming a cavity therein (the semi-sphere 60 may be made from clear plastic or other durable material allowing the transmission of light therethrough).

Process to Assemble

Figure 3:
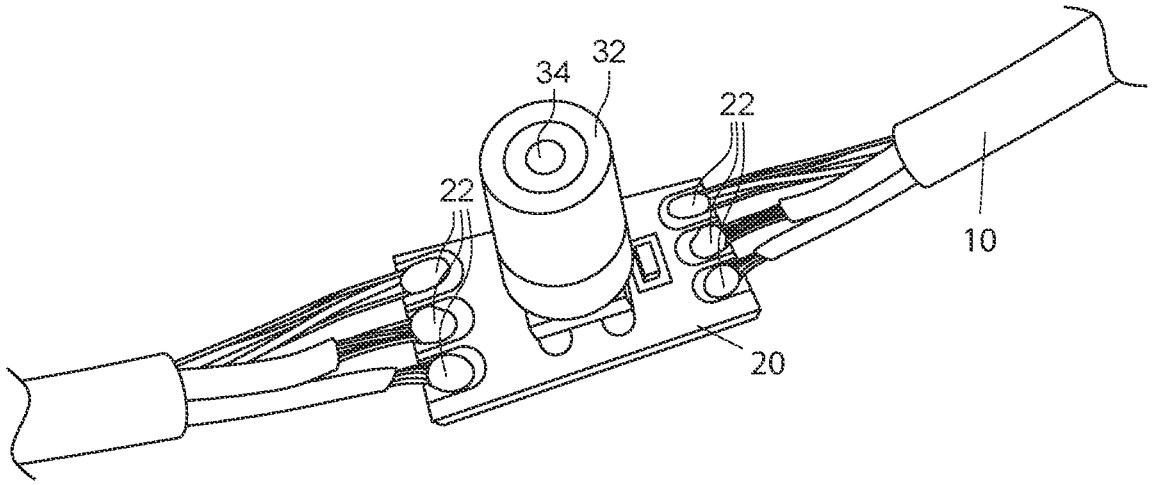
FIG. 3 is a perspective view of an exemplary embodiment of the present invention, showing an electrical coupling of the electrical connection 10 to the programmable lighting element 20 as well as a connection of the cylinder 30 connected thereto.

As illustrated in FIG. 3, a manufacturer may solder the one or more electrical connections 10 to one or both sides of the programmable lighting element 20, wherein the signal connectors 12, 14, and 16 electrically connect to a plurality of pins or nodes 22 of the programmable lighting element 20. The manufacturer may adhere a flat end of cylinder 30 to the programmable lighting element 20. The programmable lighting element 20 may be generally planar or flat and have the plurality of nodes 22 of one or opposing sides of its planar body.

Figure 4:
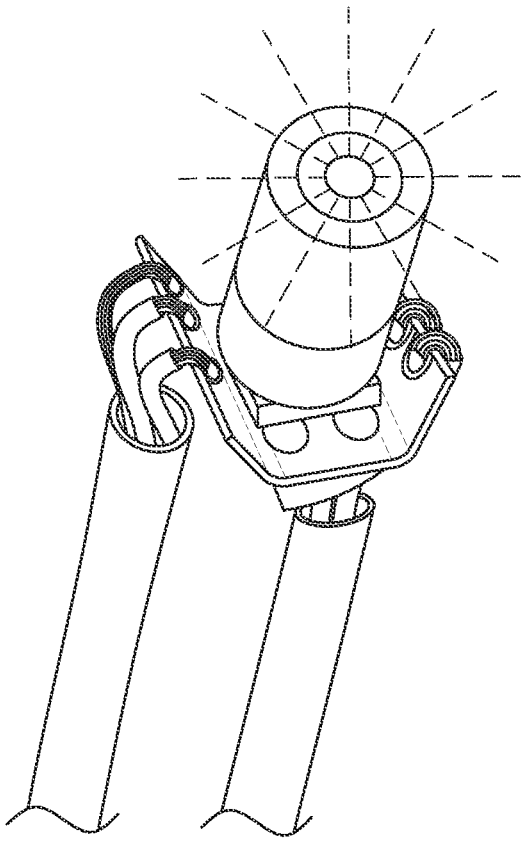
FIG. 4 is a perspective view of an exemplary embodiment of a folded assembly of the present invention.

Referring to FIG. 4, the manufacturer may fold the signal connectors 12, 14, and 16 and the respectively coupled sides of the programmable lighting element 20 in a manner that enables both the signal connectors 12, 14, and 16 and the programmable lighting element 20 (hereinafter "folded assembly") to fit inside the ring 40. The coupled sides of the programmable lighting element 20 may be folded upward so as to be generally parallel and adjacent with the sidewall of the cylinder 30, while the signal connectors 12, 14, and 16 may fold downward from the respective coupled side, outward of the folded portions of the programmable lighting element 20 (relative to the cylinder 30).

Figure 5:
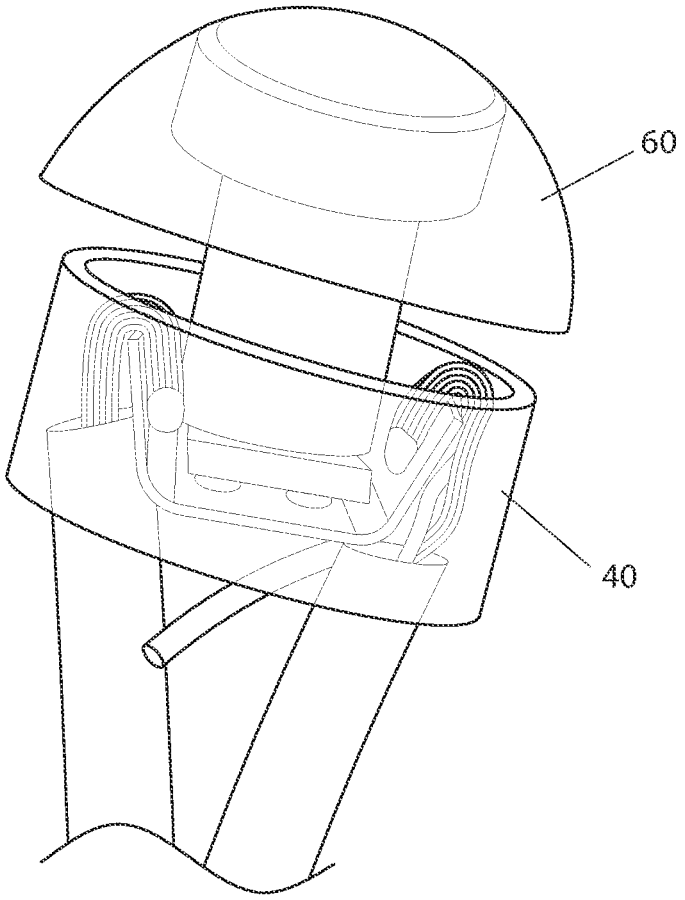
FIG. 5 is a perspective view of an exemplary embodiment of the present invention, illustrating the coupling of the folded assembly to an inner circumference of a ring 40.

Referring to FIG. 5, the manufacturer may insert the folded assembly into ring 40. Then the manufacturer may temporarily place the semi-sphere 60 placed on the cylinder 30 to check the spacing between the semi-sphere 60 and the folded assembly is correct. The spacing should match the width of the target eye hole (not shown). The manufacturer may adhere the folded assembly to the inner circumference of the ring 40 to immobilize the folded assembly. Glue or other forms of adhesion may be used.

Figure 6:
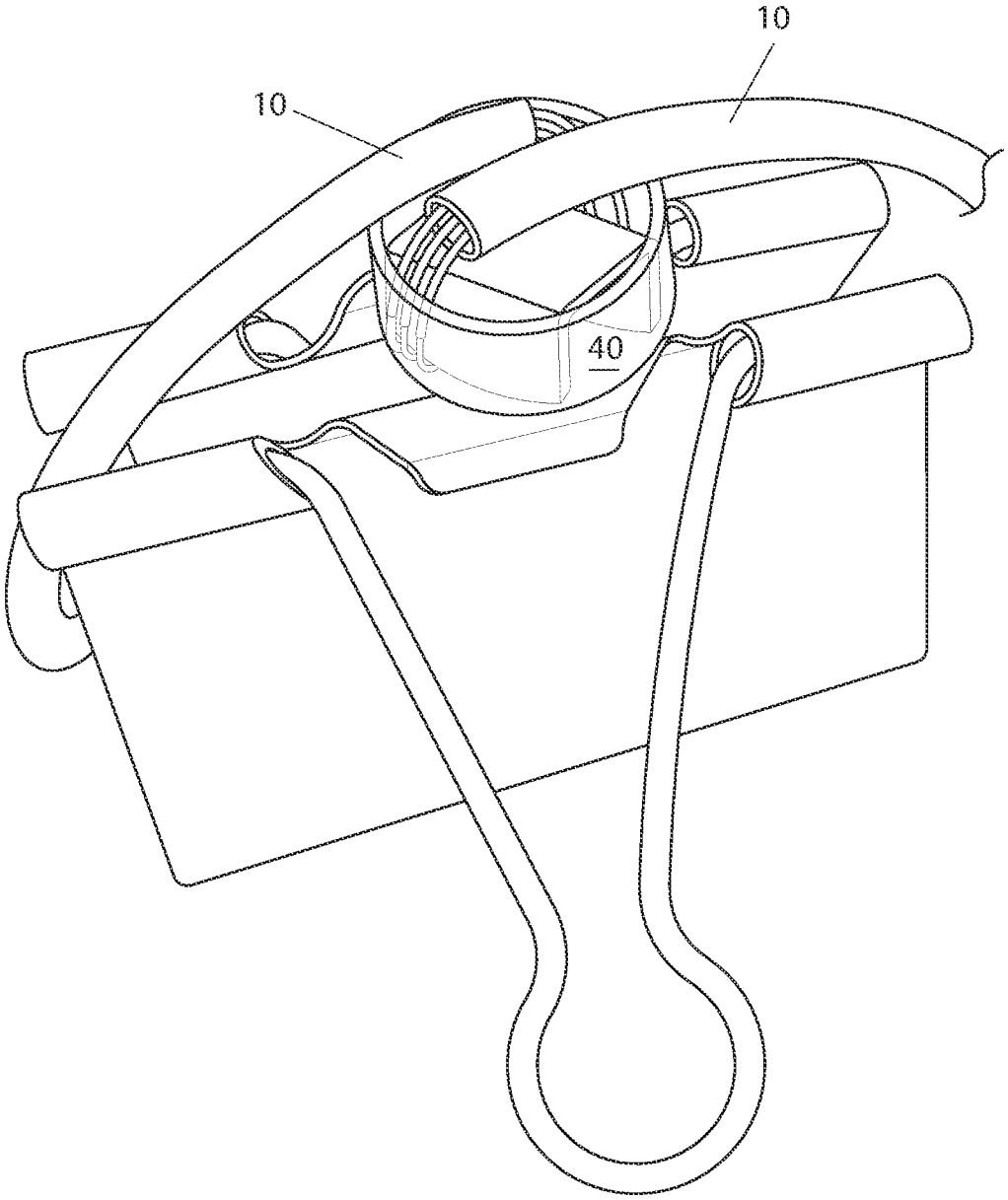
FIG. 6 is a perspective view of an exemplary embodiment of the present invention, illustrating a durable connection of the electrical connections 10 to the combination folded assembly and the ring 40.
Figure 7:
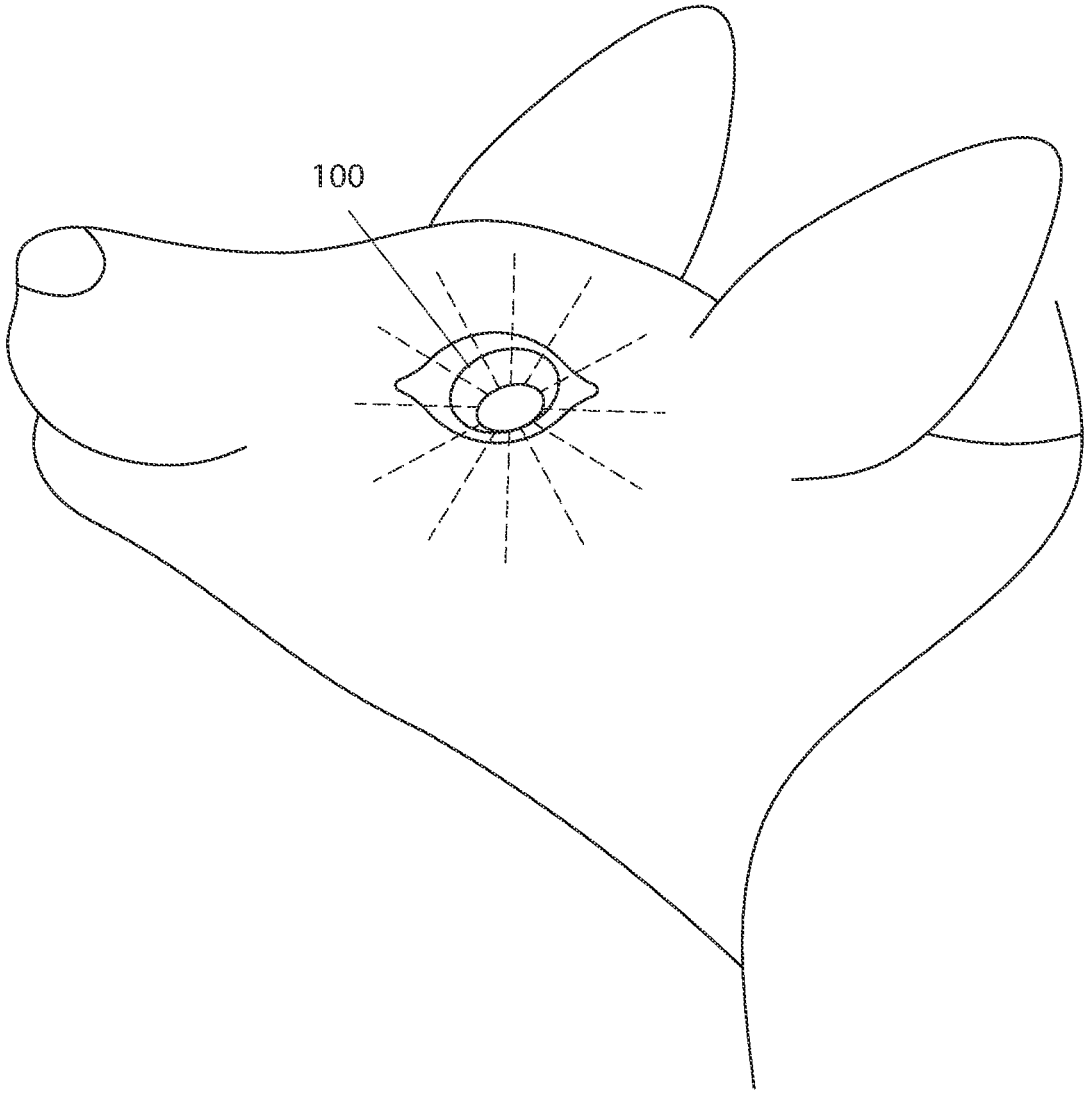
FIG. 7 is a perspective view of an exemplary embodiment of the present invention, shown in use.

Referring to FIG. 6, the manufacturer may adhere the electrical connections 10 across a rear portion of the combination folded assembly and ring 40. It should be understood that other configurations of immobilizing the electrical connection may lend itself to similar durability afforded the folded assembly adhered to the inner circumference of the ring 40, though the inventor has found this configuration to be sufficiently physically durable so as to prevent electrical disconnection between the electrical connections 10 and the programmable lighting element 20. The manufacturer may then adhere to semi-sphere 60 to a front portion of said combination.

Then the manufacturer may adhere to opaque disc 50 into the back of the hole of the semi-sphere 60, thereby creating a replica pupil of the programmable illuminated replica eye 100.

Then the manufacturer or other user may insert the programmable illuminated replica eye 100 into the destination fabric (i.e., an eye hole or hole where the eye should be), the result illustrated in FIG. 8.

Note that the cylinder 30 acts both as an anchoring conduit and as a conduit to transmit the light from the programmable LED 10 to the semi-sphere 60. The cylinder 30 may be selectively drilled out to generate a concave cone 34 to obtain a desired reflective angle that adds to the luminosity (as opposed to the cylinder 30 simply being flat).

The semi-sphere 60 could be other shapes to represent different kinds of eyes. The opaque disc 50 could be other shapes to represent different kind of pupils. The arcuate piece or ring 40 may have a diameter less than three-quarters of an inch.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A replica eye with programmable iris illumination, the replica eye comprising:

a programmable lighting element having a planar base with a plurality of electrical pins outward of a centrally disposed light source;

a transparent cylinder extending between a first and a second end, wherein the first end overlays an upper surface the light source so that sidewalls of the transparent cylinder evenly distribute light emitted from the light source, and wherein the second end physically couples to a semi-spherical object with a hole for receiving said second end.

2. The replica eye of claim 1, further comprising an opaque body disposed along the second end of the cylinder.

3. The replica eye of claim 2, further comprising a conical shape recessed in the second end.

4. The replica eye of claim 3, wherein the first end and said upper surface of the light source are approximately coextensive.

5. A replica eye with programmable iris illumination, the replica eye comprising:

a programmable lighting element having a planar base with a plurality of electrical pins outward of a centrally disposed light source;

one or more electrical connections electrically coupled to the plurality of electrical pins;

a transparent cylinder extending between a first and a second end, wherein the first end overlays an upper surface the light source, wherein the first end and said upper surface of the light source are approximately coextensive; and wherein outward portions of the planar base and their electrical connections are folded upward to extend generally parallel with the sidewalls of the cylinder to an elevation above that of the light source.

6. The replica eye of claim 5, further comprising an opaque body disposed along the second end of the cylinder.

7. The replica eye of claim 6, further comprising an iris cap receiving said second and the opaque body.

8. The replica eye of claim 7, wherein the iris cap is a semispherical object with a hole for receiving said second end.

9. The replica eye of claim 6, wherein the opaque body is a disc.

10. The replica eye of claim 5, further comprising a ring for receiving the folded outward portion so that they can be adhered to an inner circumference of the ring.

11. The replica eye of claim 5, further comprising a conical shape recessed in the second end.

12. A method of making a replica eye with programmable iris illumination, the method comprising:

electrically coupling one or more electrically connections to a programmable lighting element having a planar base with a plurality of electrical pins outward of a centrally disposed light source;

coextensively abutting one end of a transparent cylinder to an upper surface of the light source; and folding outward portions of the planar base and their electrical connections upward to extend generally parallel with the sidewalls of the cylinder to an elevation above that of the light source.

13. The method of claim 12, further adhering the folded outward portions along an inner circumference of a ring.

14. The method of claim 13, further adhering the one or more electrical connections along a rear portion of the ring.

15. The method of claim 14, further adhering an opaque body to another end of the cylinder; and sliding an iris cap over said other end and opaque body.

* * * * *